US012606982B2

(12) United States Patent
Blevins et al.

(10) Patent No.: US 12,606,982 B2
(45) Date of Patent: Apr. 21, 2026

(54) METHODS FOR SUPPRESSION OF SEABED MINING PLUMES

(71) Applicant: Deep Reach Technology, Inc., Houston, TX (US)

(72) Inventors: Robert D. Blevins, San Diego, CA (US); John Halkyard, Houston, TX (US); Michael Rai Anderson, Houston, TX (US); James Wodehouse, Llano, NM (US); Samual Holmes, Palo Alto, CA (US)

(73) Assignee: Deep Reach Technology, Inc.

( * ) Notice: Subject to any disclaimer, the term of this patent is extended or adjusted under 35 U.S.C. 154(b) by 199 days.

(21) Appl. No.: 18/546,267

(22) PCT Filed: Feb. 11, 2022

(86) PCT No.: PCT/US2022/016221

§ 371 (c)(1),
(2) Date: Aug. 11, 2023

(87) PCT Pub. No.: WO2022/174106

PCT Pub. Date: Aug. 18, 2022

(65) Prior Publication Data

US 2024/0110361 A1 Apr. 4, 2024

Related U.S. Application Data

(60) Provisional application No. 63/149,141, filed on Feb. 12, 2021.

(51) Int. Cl.

| | |
|---|---|
| ***E21C 50/00*** | (2006.01) |
| ***E02F 3/88*** | (2006.01) |
| ***E02F 3/94*** | (2006.01) |

(52) U.S. Cl.
CPC ..... *E02F 3/945* (2013.01); *E02F 3/8866* (2013.01); *E21C 50/00* (2013.01)

(58) Field of Classification Search
CPC E21C 50/00; E02F 3/945; E02F 7/005; E02F 3/94

(Continued)

(56) References Cited

U.S. PATENT DOCUMENTS 4,040,667 A * 8/1977 Tax ..... E21C 50/00 299/8
4,997,549 A 3/1991 Atwood (Continued)

FOREIGN PATENT DOCUMENTS

| | | |
|---|---|---|
| CN | 107075395 A | 8/2017 |
| JP | s5891290 B | 10/1988 |
| WO | 2020172434 A1 | 8/2020 |

OTHER PUBLICATIONS

Supplementary European Search Report, PCT/US2020/019075, Dated Mar. 17, 2022.

(Continued)

*Primary Examiner* — Sunil Singh
(74) *Attorney, Agent, or Firm* — Saunders McKeon PLLC

(57) ABSTRACT

This disclosure addresses the problem of preventing sediment laden water ("sediment slurry") resulting from hydraulic collection of nodules from the seabed from entering the riser and lift system that carries the nodules to the surface as a slurry. An example includes collecting nodules from the seabed by hydraulic suction, separating the nodules utilizing an inverse hydrocyclone.

14 Claims, 6 Drawing Sheets

(58) Field of Classification Search
USPC ..... 299/8, 9; 37/307, 314, 317
See application file for complete search history.

(56) References Cited

U.S. PATENT DOCUMENTS

| | | | | |
|---|---|---|---|---|
| 2009/0284068 | A1 | 11/2009 | Yu et al. | |
| 2010/0269696 | A1 | 10/2010 | Sarshar et al. | |
| 2014/0137443 | A1 | 5/2014 | Jones et al. | |
| 2018/0266074 | A1 | 9/2018 | Halkyard et al. | |
| 2018/0291588 | A1 | 10/2018 | Subrahmanyam | |
| 2022/0178108 | A1* | 6/2022 | Halkyard ..... | E02F 3/94 |

OTHER PUBLICATIONS

Written Opinion of The International Searching Authority, PCT/US22/16221, Jun. 21, 2022, 7 pages.
Written Opinion of the International Searching Authority, PCT/US20/019075, Jun. 22, 2020, 5 pages.

* cited by examiner

METHODS FOR SUPPRESSION OF SEABED MINING PLUMES

RELATED APPLICATIONS

This application is a national phase application of PCT/US22/16221, filed Feb. 11, 2022, which claims the benefit of priority to U.S. Provisional Application No. 63/149,141, filed Feb. 12, 2021.

This invention was made with government support under contract DE-AR0001234 awarded by ARPA-E, the Advanced Research Projects Agency-Energy. The government has certain rights in the invention.

BACKGROUND

Seabed mining may be the only resource large enough to fill the impending gap in terrestrial supplies for nickel, cobalt, and rare earth elements. One barrier to commercialization of these resources is the potential for environmental impact of sediment plumes. There are two principle potential plume sources of interest. The first is created at the collector vehicle itself from disturbance of the sediment as the vehicle traverses the seabed, and the second from the sediment in the water used to remove the nodules from the seabed by hydraulic suction. In one example of prior-art shown herein as FIG. 1, approximately 90% of this sediment laden water is removed from the nodule slurry before it is raised to the surface by a riser and lift system. Any sediment retained in the slurry lifted to the surface is separated from the nodules during dewatering on the mining or transport vessels, and returned in a discharge pipe to an intermediate depth in the ocean.

SUMMARY OF EXAMPLE EMBODIMENTS

This disclosure describes an improved method for concentrating nodules pickup by a nodule collector and preventing sediment laden water from the pickup heads from entering a hydraulic vertical transport system, or riser. An example embodiment may include an apparatus for recovering seafloor minerals having a collecting apparatus for recovering nodules, sediment and water from the seabed using a hydraulic pickup head, a first pipe connecting a pickup head to a diffuser and an inlet of a first gravity separator, the gravity separator having an overflow and an underflow, the underflow of the first gravity separator connected to pipe which is connected to an inverse hydrocyclone having a cylindrical chamber with a pipe connecting the gravity separator underflow to the top of the cylindrical chamber, and two openings tangential to the outer circumference of the cylindrical chamber, and a first pump with an inlet and an outlet, wherein the inlet is exposed to the outside environment and an outlet which is connected the first tangential opening in the cylindrical chamber.

A variation of the example embodiment may include a second pipe connecting the second tangential opening in the cylindrical chamber to a second gravity separator having an opening to the outside environment at the top and an underflow at the bottom. It may include the underflow of the second gravity separator being connector to a subsea pipe which conveys a slurry to a lift system for conveying nodules and water to the surface. The gravity separator overflow may be connected to an outlet having a diffuser which feeds the overflow to the outside environment. It may include a second pump conveys fluid from the outlet of the separator to the diffuser for discharge to the outside environment. It may include a third pipe connecting the underflow of the first gravity separator to a second pipe which connects the outlet of the first pump to a second gravity separator. The third pipe may be perforated to allow clean water to enter the first pipe.

An example embodiment may include an apparatus for recovering seafloor minerals having a collecting apparatus for recovering nodules, sediment and water from the seabed using a hydraulic pickup head, a first pipe connecting a pickup head to a diffuser and an inlet of a first gravity separator, the gravity separator having an overflow and an underflow, a first pump with an inlet and an outlet, wherein the inlet is exposed to the outside environment and an outlet which is connected the bottom of the underflow of the gravity separator, and a second pipe which connects the underflow and outlet of the first pump to a second gravity separator including an opening to the outside environment at the top and an underflow at the bottom.

A variation of the example embodiment may include the underflow of the second gravity separator being connector to a subsea pipe which conveys a slurry to a lift system for conveying nodules and water to the surface. It may include a third pipe connecting the underflow of the first gravity separator to a second pipe which connects the outlet of the first pump to a second gravity separator. The third pipe may be perforated to allow clean water to enter the first pipe. The gravity separator overflow may be connected to an outlet including a diffuser which feeds the overflow to the outside environment. It may include a second pump conveys fluid from the outlet of the separator to the diffuser for discharge to the outside environment.

An example embodiment may include a method for mining the subsea floor including generating a first slurry by removing a surface layer of the subsea floor and mixing it with water, flowing the first slurry first to a first gravity separator, flowing the water and fine particles from the first slurry to the overflow of the first gravity separator forming a second slurry, collecting particles from the first slurry that do not pass through the overflow of the first gravity separator at the underflow of the first gravity separator, directing particles to enter a stream of water from the surrounding environment to create a third slurry that is passed to a second gravity separator that is open to the environment, and controlling the pressure at the underflow of the first separator to remain independent of the pressure at the underflow of the second separator.

It may include mixing a stream of water from the surrounding water and the particles that pass to an underflow of a first separator in a cylindrical chamber, wherein the water from the surrounding environment enters tangentially to the cylinder creating a cyclonic flow. It may include maintaining a desired relative pressure differential between the particles from the underflow of the first separator enter at the top of the cylinder, the third slurry, and the interior of the first gravity separator.

An example embodiment may include an apparatus for recovering seafloor minerals having a plurality of collecting devices contained in a subsea vehicle for recovering nodules, sediment and water from the seabed, each collecting device further comprising a hydraulic pickup head, a first pipe connecting a pickup head to a diffuser and an inlet of a first gravity separator, the gravity separator having an overflow and an underflow, wherein the underflow of the first gravity separator connected to pipe which is connected to an inverse hydrocyclone having a cylindrical chamber with a pipe connecting the gravity separator underflow to the top of the cylindrical chamber, and two openings tangential to the outer circumference of the cylindrical chamber, and a first pump with an inlet and an outlet, wherein the inlet is exposed to the outside environment and an outlet which is connected the first tangential opening in the cylindrical chamber.

It may include each collecting device further having a second pipe connecting the second tangential opening in the cylindrical chamber to a second gravity separator having an opening to the outside environment at the top and an underflow at the bottom. Each collecting device may have the underflow of the second gravity separator is connector to a subsea pipe which conveys a slurry to a lift system for conveying nodules and water to the surface. Each collecting device may have the gravity separator overflow is connected to an outlet having a diffuser which feeds the overflow to the outside environment. Each collecting device may include a second pump to convey fluid from the outlet of the separator to the diffuser for discharge to the outside environment. Each collecting device may a third pipe connecting the underflow of the first gravity separator to a second pipe which connects the outlet of the first pump to a second gravity separator. Each collecting device may have the third pipe perforated to allow clean water to enter the first pipe.

BRIEF DESCRIPTION OF THE DRAWINGS

For a thorough understanding of the present invention, reference is made to the following detailed description of the embodiments, taken in conjunction with the accompanying drawings in which reference numbers designate like or similar elements throughout the several figures of the drawing. Briefly.

DETAILED DESCRIPTION OF EXAMPLE EMBODIMENTS

Figure 1:
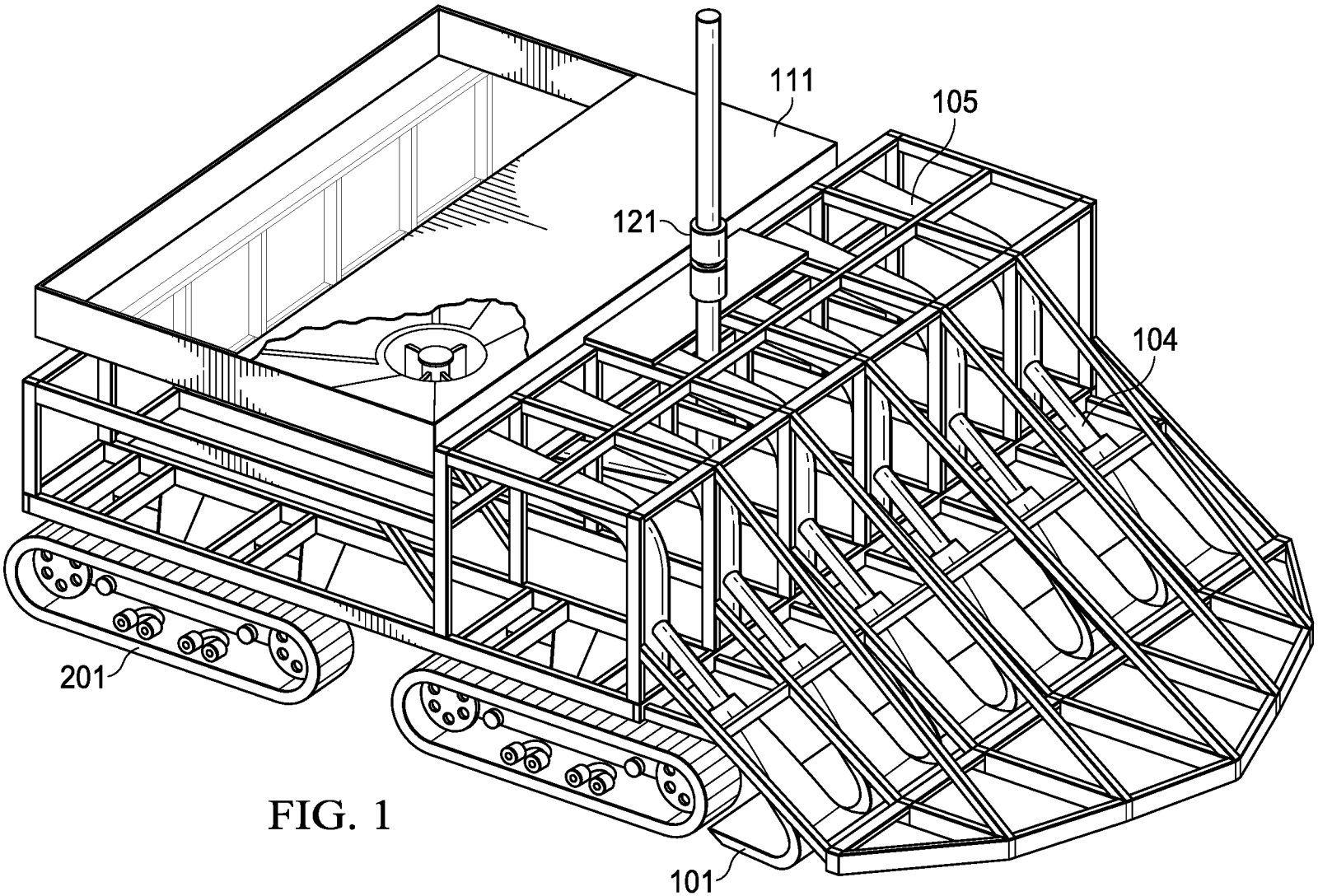
FIG. 1 depicts a hydraulic nodule collector with supporting structure to function as a complete seafloor collecting vehicle.

FIG. 1 shows a rendering of a hydraulic nodule collector with supporting structure to function as a complete seafloor collecting vehicle. This embodiment is propelled along the seafloor by tracks 201. Another embodiment would be supported on skids and would be towed across the seafloor along said skids using the riser system to provide towing force. Nodule and sediment enter collector heads 101 at the front of the collector and are conveyed to a hopper 111 by means of a pump (not shown) in duct 104 to create the suction for picking up the nodules from the seafloor. The suction is created by high velocity water passing through a venturi opening between the collector head 101 and the seabed. In addition to picking up nodules in the flow, the water entrains fine sediment material, primarily clay, which creates a sediment slurry. The diffuser 105 reduces the flow velocity for flow entering hopper 111, also referred to as the "separator", allowing the nodules to settle by gravity to the bottom of the hopper while sediment slurry passes out the top of the hopper. The bottom of the hopper is coupled to the riser 121 to create a concentrated slurry for efficient vertical transport. About 10% of the sediment slurry collected by the collector heads enters the riser and is conveyed to the mining vessel with the nodules where, upon dewatering the nodule slurry, the sediment slurry becomes waste which is discharged in the sea through a separate discharge pipe to some depth below the free surface. The remaining 90% of the sediment slurry is discharged through an opening at the top of hopper 111.

Figure 2:
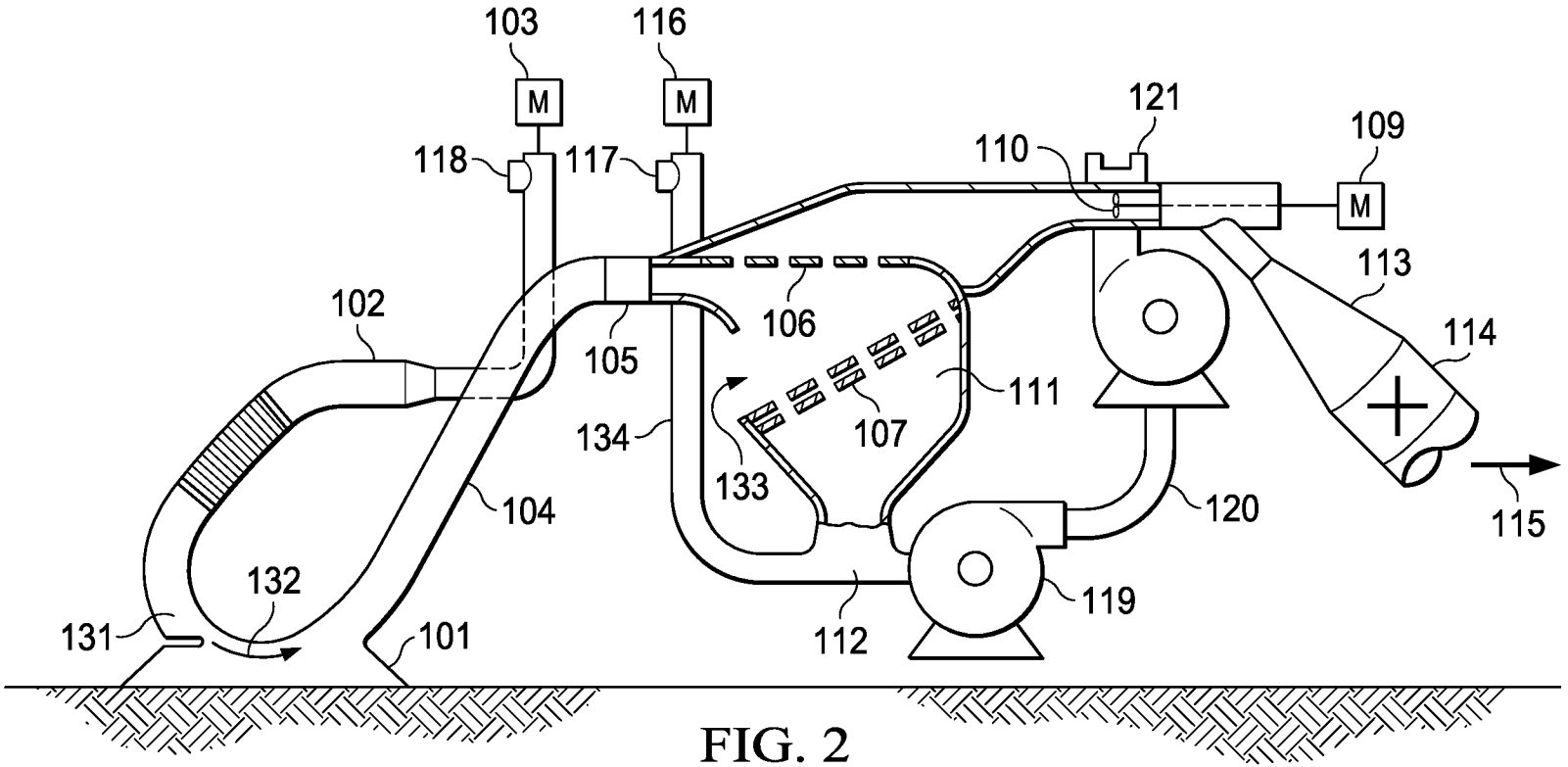
FIG. 2 depicts a cross section of an embodiment of a hydraulic nodule collector.

FIG. 2 illustrates an example embodiment where nodules, sediment and water are entrained by passing a jet of water 132 through the collector head 101. This jet is produced by pumping seawater entering inlet 118, through a pump driven by a motor 103 through ducting 102 to the jet nozzle 131. The jet nozzle 131 is configured to cause the water flow to follow the contour of the collector head 101 by the principle of Coanda flow. The flow entrains additional seawater, nodules and sediment which passes through the ducting 104. The flow may be boosted by an additional pump (not shown) in ducting 104 to increase the pressure in the flow. The flow of nodules, seawater and sediment passes through a diffuser 105 to reduce flow velocities, turbulence and dynamic head. The flow enters a separator/hopper 111 which separates the sediment and seawater from the collected nodules. Separation is achieved by inducing flow through a screen 106 with a pump 110 driven by a motor 109. Screen 106 may be sized to only allow particles of less than, e.g. 5 mm in diameter to pass. Nodules and a portion of the collected water and sediment fall to the bottom of the hopper 111 to form a concentrated mixture (slurry) 112 to enter the lift system 121. The pump 110 driven by motor 109 is controlled to force all or most of the collected water and sediment passing through duct 104 to pass through the screen 106. Screen 106 would likely be a non-clogging type of screen larger particles fall by gravity through a coarse screen 107 into the bottom of the hopper where they are entrained in flow from duct 134 and pumped to a riser pipe 121 by pump 119 through duct 120. The coarse screen 107 may be designed to remove particles larger than e.g. 15 cm in diameter that could block the riser pipe 121, the removed particles are discharged to the seabed through opening 133. In this example embodiment the concentrated mixture slurry 112 may include particles between about 1 mm and 150 mm in diameter. The range of particle sizes to be screened can be adjusted up and down for both the fine screen 106 and the coarse screen 107, based on the range of minerals desired for recovery. Whereas the liquid flow from the bottom of the hopper in the prior art concept illustrated in FIG. 1 directly flowed to the riser 121, in the embodiment illustrated in FIG. 3 the liquid carrying nodules to the riser includes clean make up water delivered to duct 134 by pump and motor 116, drawing in water via inlet 117, which is controlled to achieve the optimum concentration of solids delivered to the lift system through pump 119 and duct 120. Inlet 117 is suspended high enough above the seafloor so that it will recover only clean water. In this way none of the sediment slurry created by the pickup head 101 enters the riser 121.

The sediment, water, and smaller particles that are pumped through screen 106 pass through pump 110 and enter diffuser 113 to reduce the flow velocity and turbulence in the flow. In this embodiment, the flow from the diffuser 113 is passed through an electrocoagulator 114 which causes the sediment particles to self-flocculate and settle more quickly to the seabed when discharged as a slurry 115 behind the collector. The elctrocoagulator is optional, and the sediment slurry mixture may be conveyed directly from the diffuser 113 to the sea, where the sediment particles will settle naturally. The flow of sediment and water through pump 110 and diffuser 113 would be deposited close to the seafloor at a discharge velocity close to the forward velocity of the collector for the discharged solids to settle in the wake of the collector. Screen 106 and pump 110 are also optional and may not be necessary if the flow of sediment slurry and nodules can be controlled by means described below.

Figure 3:
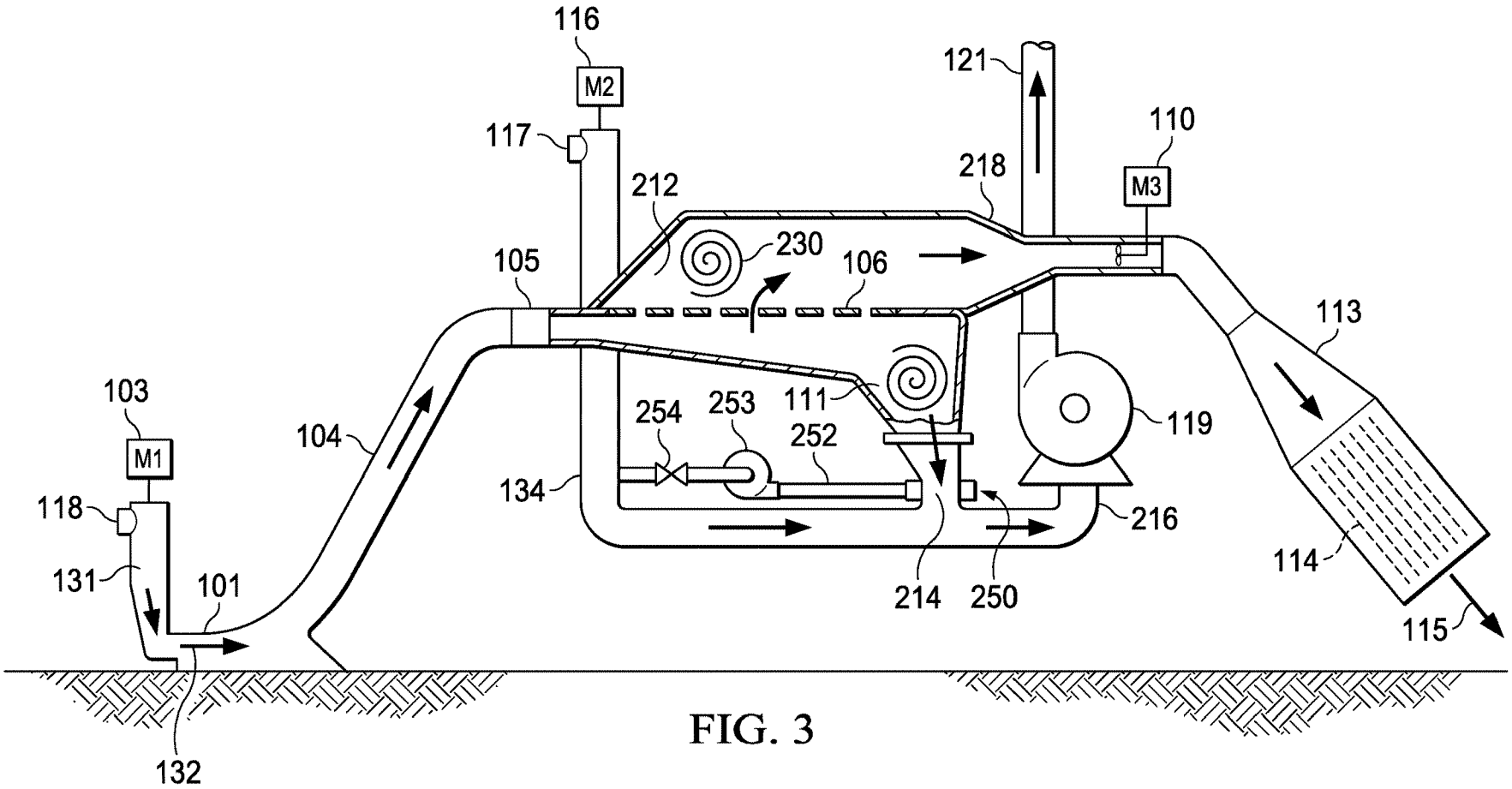
FIG. 3 depicts a cross section of an embodiment of a hydraulic nodule collector with a perforated throat in the separator underflow.

FIG. 3 is a schematic of a cross section of one configuration of the example embodiments illustrating the functioning of the gravity separator. The complete nodule collector may include several nodule pickup heads 101 which feed multiple hoppers 111, similar to the one illustrated in FIG. 1. The illustration on FIG. 3 is a section through one of the pickup heads and one separator. The analysis proceeds point by point, component by component through a 1 meter thick slice of the collector. The values are indicative of a commercial nodule collector.

Seawater enters a point 118 at 0.58 cubic meters a second per meter of collector (typical value based on previous testing). About 36 kW power pump driven by motor 103 is required to raise the sea water pressure from ambient pressure to 11500 Pa (1.67 psi) above ambient to achieve approximately 8 m/s flow at the collector head Coanda nozzle 131 which results in flow 132 through the collector head 101 that scours nodules and sediment from the sea bed at the collector head 101. The mixture of sediment, water (sediment slurry) and nodules is lifted into a duct 104 angled at 45 degree to the seabed at a velocity of approximately 3.5 m/s. Before entering the hopper, the duct 104 expands out of plane in section 105 and then expands at 45 degrees in plane 212. These abrupt expansions result in a 0.3 psi pressure loss, associated with separation which creates an unsteady counter-clockwise eddy 230 at the entrance to the hopper 111.

The hopper 111 is a gravity particle separator. A 1 mm nodule settles with a terminal velocity of about 0.1 m/s at Reynolds number of 60. Fine sediment, which settles much more slowly, at about 0.1 m/day (for 1 micron clay particles), is carried with 99% of the flow of solids to the sediment slurry exhaust 218. The larger nodules settle to the bottom of the hopper 111 and enter the discharge throat 214. Twenty six (26) cubic meters per hour of nodule material, about 1.25% of the incoming flow of 2098 cubic meters per hour goes to the discharge throat 214 at the bottom of hopper 111. The nodules would accumulate at the bottom of the hopper except for the makeup flow from the sea through opening 117 provided by pump driven by motor 116 through duct 134 that moves nodules out of the bottom of the hopper. The fine particles do not settle out. They flow slightly upward through a 50% open screen 106, or through an opening without a screen, to a pump, 110, a diffuser 113 and through a bank of parallel plates 114 which, when connected so that an electrical current passes through the slurry, results in electrocoagulation and formation of large flocs to enhance settling of the sediment particles. Flow to the electrocoagulator 114 expands in a diffuser and is exhausted back into the sea 115. The screen 106 has ½ inch (10 mm) opening to prevent larger particles from exiting to the discharge 218.

The analysis indicates that the static pressure in the hopper 111 is relatively small, less than 1000 Pa (0.14 psi) above ambient hydrostatic pressure. The flow out of the hopper is controlled by pumps 110, for the fine particle slurry, pump 116 for the makeup water and 119, for the concentrated nodule slurry, which must either be synchronized displacement pumps or controlled by a differential pressure sensors, to maintain balance between the two outlets from the hopper. For total exclusion of sediment from the feed 216 to the nodule riser and lift system a small upward flow at discharge throat 214 is desired.

There are hydraulic challenges with this hopper design including a) the abrupt expansion at the hopper entrance 212 causes flow to separate, producing a vortex 230 and unsteady non uniform flow which is not conducive to gravity sedimentation and creates pressure loss, b) the screen 106 has potential for clogging and contribute to maintenance, c) the multiple pumps 103, 116, 110 and 119 in the design are redundant, so either the pumps must be displacement-controlled type, which can be sensitive to transported sediments, or an automatic pressure control must be introduced, adding to the complexity, and similarly d) there is feedback from makeup water from pump 116 and the suction from the riser pump system in 121 to the hopper 111, so control must also extend from the riser lift pump to collector pumps, and e) the very small pressure differential between the hopper 111 and the discharge 216 that must be maintained to control the upflow at the bottom of the hopper is below the sensitivity of pressure sensors currently available.

FIG. 3 also shows an optional plenum 250 which allows clean water delivered by pump 253 though a control valve 254 and duct 252 to enter the discharge throat 214. This embodiment can assist in the stabilization and control of the upflow in the throat 214.

Figure 4:
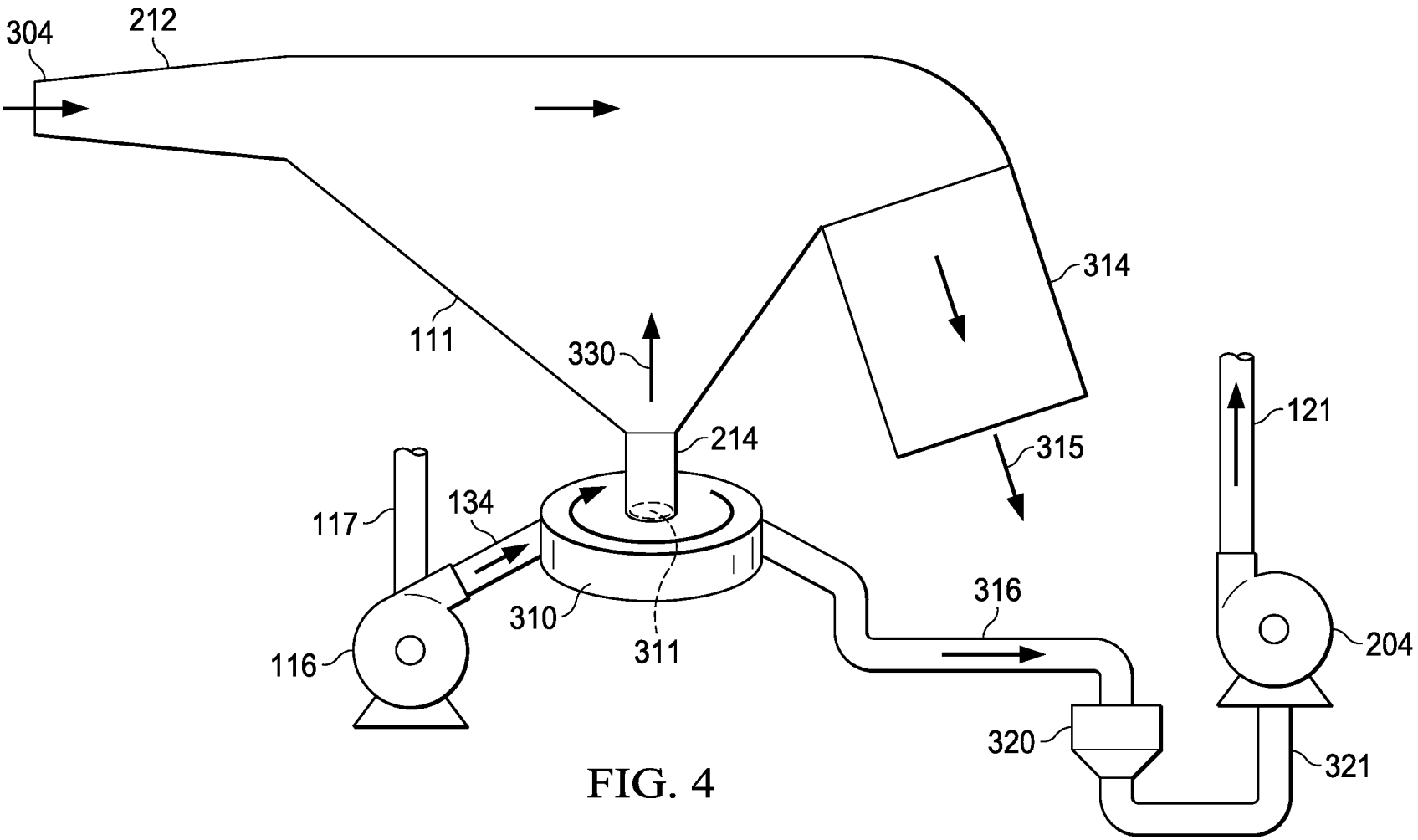
FIG. 4 depicts a diagram of an example embodiment with an inverse hydrocyclone and second gravity separation hopper.

FIG. 4 shows an improved collector system which is the subject of an example embodiment which mitigates the above concerns. The hydraulic pickup and inclined pipe to entrance 304 and diffuser 212 are the same as illustrated in previous Figures. To mitigate the vortex generation at the entrance to the hopper 111 from duct 104, an improved diffuser 212 with a maximum expansion angle of eight degrees is utilized. As nodules fall under gravity in the hopper 111 they are washed by an upflow of clean water 330 from an inverse hydrocyclone 310 which is supplied clean water through duct 117 by pump 116 through duct 134. This upflow 330 ensures that only large mineral-rich nodules pass to the hopper underflow 316. The upflow 330 comes from an opening 311 in the center of the inverse hydrocyclone 310 top cover, and throat 214, that allows the nodules greater than a minimum diameter to pass in the opposite direction into the inverse hydrocyclone chamber while excluding sediment slurry from entering the hopper underflow 316.

The inverse hydrocyclone 310 differs from a standard hydrocyclone in that the inflow 134 is clear water rather than the conventional cyclone's combination of water and solids. Pressurized water enters the cyclone tangentially, creating a circumferential vortex in the cyclone chamber. Centrifugal force carries the larger nodules in the cyclone outward to the lower edge of the cyclone cylinder where they exit and pass to the hopper underflow 316. The cyclone central pressure is adjusted using exit pressure differential in hopper underflow 316, relative to sea water pressure, to remain slightly higher than the pressure in the hopper thus creating a small upflow into the hopper, with a velocity above the fine sediment terminal falling velocity but below the terminal falling of the minimum size nodules.

In order to stabilize and control this upflow, the pressure at the discharge throat 214 is isolated from the variation is the suction of the riser 121 by introducing a second hopper 320, referred to as the "riser hopper". The discharge from the first hopper through hopper underflow 316 enters the second hopper 320 at a constant ambient pressure as hopper 320 is open to the sea. Thus, the differential pressure between the hopper 111 and the top of the hydrocyclone 310, which establishes the upflow, is dependent only on the pressure drop in the hydrocyclone and hopper underflow 316 coupled with the pressure drop between the hopper 111 and the hopper outlet 314 and overflow discharge 315.

The pressure drop from the hopper 111 to the exterior through the discharge 315 or through the hopper 111 to the second hopper 320 are relatively equal and can designed so that a small upflow in the hopper underflow may be sustainable.

This improvement potentially eliminates the need for pump 110 in FIG. 3.

In FIG. 4, the underflow from second hopper 320 is coupled to riser 121 through duct 321 and optional booster pump 204.

Figure 5:
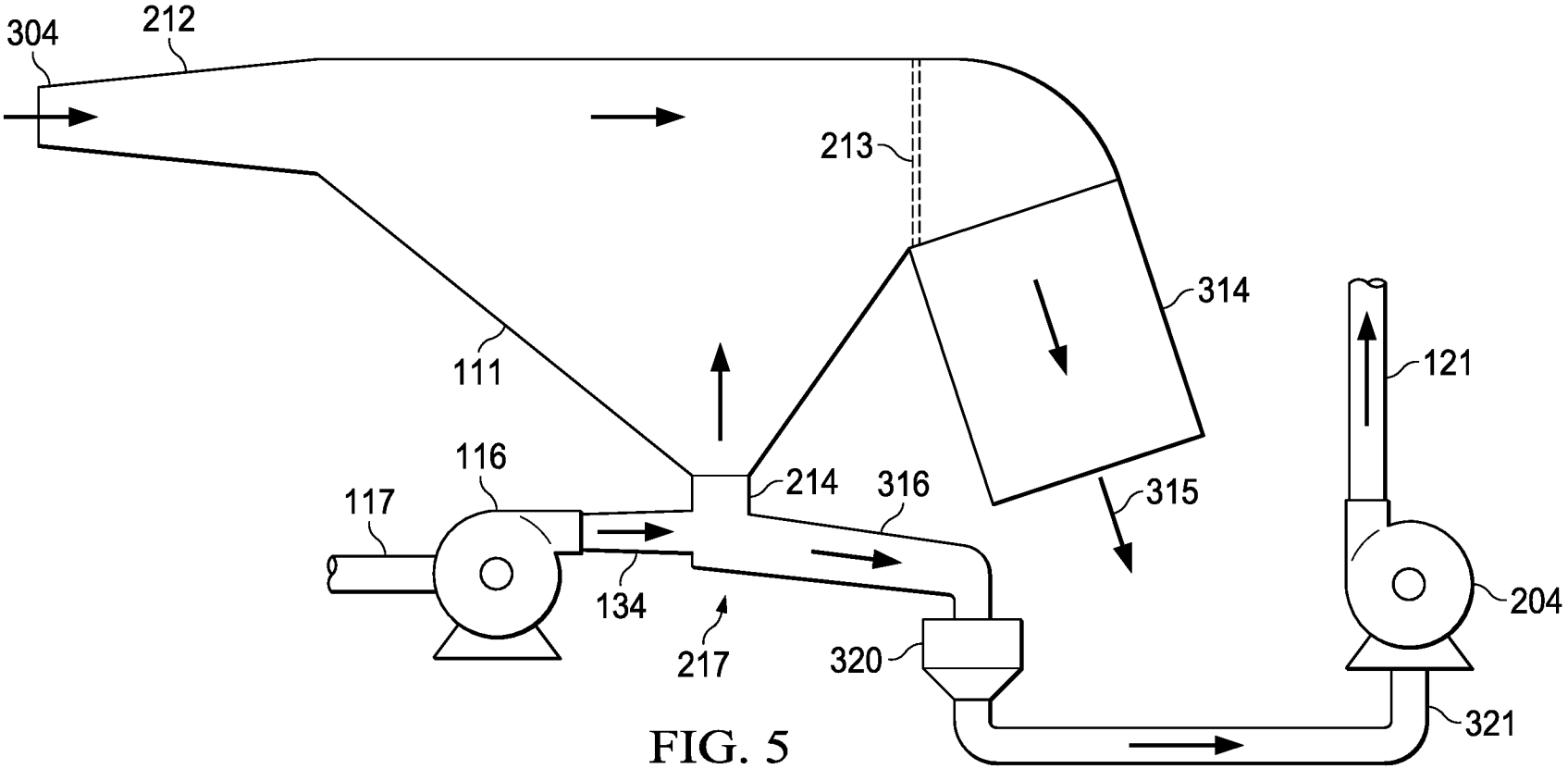
FIG. 5 depicts an example embodiment with an inverse hydrocyclone replaced by a "T" junction at the hopper discharge.

FIG. 5 shows a second embodiment of this concept with the inverse hydrocyclone 310 replaced by a "T" junction 217 between the hopper discharge throat 214, the clean water feed 134 and the hopper underflow 316. Clean water from inlet 117 is pumped by pump 116 to the feed duct 134. While this embodiment may be simpler to implement than the inverse hydrocyclone described in FIG. 4, computational fluid mechanics simulation has shown that the flow from the clean water feed 134 to the "T" junction creates eddies in the hopper discharge throat 214 which could entrain sediment laden water and allow contamination of the hopper underflow 316 with this sediment. Other computational fluid dynamics calculations indicate the inverse hydrocyclone 310 in FIG. 4 eliminates these vortices and stabilizes the upflow through the throat 214. Computational fluid dynamic calculations also indicate that adding a plenum and perforated openings to introduce clean water into the discharge throat 214, as illustrated in FIG. 3, can mitigate the formation of eddies in the discharge throat 214. Also shown in FIG. 5 is an embodiment of the first hopper overflow with a screen 213 to prevent large particles from passing out the overflow and passing through duct 314 to the outlet to the sea 315.

Figure 6:
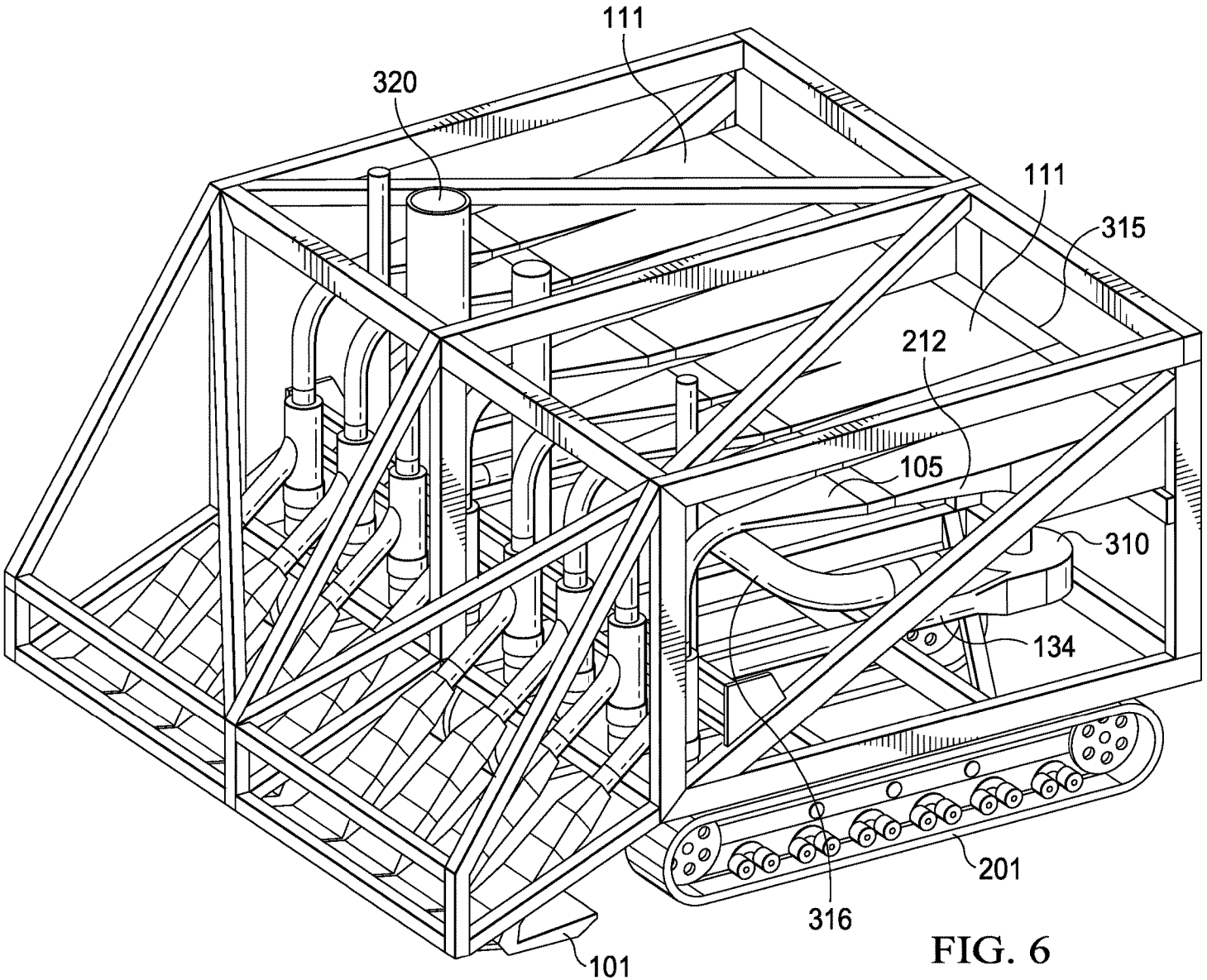
FIG. 6 depicts a hydraulic nodule collector with supporting structure to function as a complete seafloor collecting vehicle.

FIG. 6 shows a 3D sketch with the implementation of these improvement in the collector design. The collector is propelled on over the seafloor by tracks 201. This embodiment shows eight collector heads 101 and two separation hoppers 111, each serving four of the collector heads. Each collector head 101 feeds a duct with inline pump and diffusers 105 and 212 before flow enters the hopper 111. An inverse hydrocyclone 310 is fitted at the bottom of each hopper 111 and hopper underflow 316 leads to a second hopper 320 which is open to the sea. Clean water is fed to the inverse hydrocyclone 310 by duct 134. Hopper overflow is discharged to the sea at outlet 315.

What is claimed is:

1. An apparatus for recovering seafloor minerals comprising:

a collecting apparatus for recovering nodules, sediment and water from the seabed using a hydraulic pickup head;

a first pipe connecting the hydraulic pickup head to a diffuser and an inlet of a first gravity separator, the first gravity separator having an overflow and an underflow;

the underflow of the first gravity separator connected to a discharge throat which is connected to an inverse hydrocyclone having a cylindrical chamber connected to the underflow of the first gravity separator at the top of the cylindrical chamber by the discharge throat, and a first and second tangential opening tangential to the outer circumference of the cylindrical chamber; and a first pump with an inlet and an outlet, wherein the inlet of the first pump is exposed to the outside environment and the outlet of the first pump is connected to the first tangential opening in the cylindrical chamber.

2. The apparatus for recovering seafloor minerals of claim 1 further comprising a hopper underflow pipe connecting the second tangential opening in the cylindrical chamber to a second gravity separator having an opening to the outside environment at the top and a second gravity separator underflow at the bottom.

3. The apparatus for recovering seafloor minerals of claim 2 wherein the underflow of the second gravity separator is connected to a subsea pipe which conveys a slurry to a lift system for conveying nodules and water to the surface of the sea.

4. The apparatus for recovering seafloor minerals of claim 1 wherein the overflow of the first gravity separator is connected to an outlet having a diffuser which feeds the overflow to the outside environment.

5. The apparatus for recovering seafloor minerals of claim 4 further comprising a second pump conveying fluid from the overflow of the first gravity separator to the diffuser of the outlet for discharge to the outside environment.

6. The apparatus for recovering seafloor minerals of claim 3 further comprising a discharge throat plenum connecting the bottom of the first gravity separator to the hopper underflow pipe which connects the outlet of the first pump to the second gravity separator.

7. The apparatus for recovering seafloor minerals of claim 6 wherein the discharge throat plenum is perforated to allow clean water to enter the discharge throat plenum.

8. An apparatus for recovering seafloor minerals comprising:

a plurality of collecting devices contained in a subsea vehicle for recovering nodules, sediment and water from the seabed each collecting device further comprising:

a hydraulic pickup head;

a first pipe connecting the hydraulic pickup head to a diffuser and an inlet of a first gravity separator, the first gravity separator having an overflow and an underflow;

wherein the underflow of the first gravity separator connected to a discharge throat which is connected to an inverse hydrocyclone having a cylindrical chamber connected to the underflow of the first gravity separator to the top of the cylindrical chamber, and a first and second tangential opening tangential to the outer circumference of the cylindrical chamber; and a first pump with an inlet and an outlet, wherein the inlet of the first pump is exposed to the outside environment and the outlet of the first pump is connected the first tangential opening in the cylindrical chamber.

9. The apparatus for recovering seafloor minerals of claim 8 each collecting device further comprising a hopper underflow pipe connecting the second tangential opening in the cylindrical chamber to a second gravity separator having an opening to the outside environment at the top and a second gravity separator underflow at the bottom.

10. The apparatus for recovering seafloor minerals of claim 9 wherein each collecting device has the underflow of the second gravity separator is connector to a subsea pipe which conveys a slurry to a lift system for conveying nodules and water to the surface of the sea.

11. The apparatus for recovering seafloor minerals of claim 8 wherein each collecting device has the overflow of the first gravity separator is connected to an outlet having a diffuser which feeds the overflow to the outside environment.

12. The apparatus for recovering seafloor minerals of claim 11 each collecting device further comprises a second pump conveying fluid from the overflow of the first gravity separator to the diffuser of the outlet for discharge to the outside environment.

13. The apparatus for recovering seafloor minerals of claim 12 each collecting device further comprising a discharge throat plenum connecting the bottom of the first gravity separator to the hopper underflow pipe which connects the outlet of the first pump to the second gravity separator.

14. The apparatus for recovering seafloor minerals of claim 13 wherein the discharge throat plenum of each collecting device is perforated to allow clean water to enter the discharge throat plenum.

* * * * *